US007588160B2

(12) United States Patent
Chen

(10) Patent No.: US 7,588,160 B2
(45) Date of Patent: Sep. 15, 2009

(54) COMBINED STORAGE APPARATUS

(75) Inventor: Shu-Ling Chen, Taipei Hsien (TW)

(73) Assignee: Highland Champ Corporation, Tortola (VG)

( * ) Notice: Subject to any disclaimer, the term of this patent is extended or adjusted under 35 U.S.C. 154(b) by 663 days.

(21) Appl. No.: 10/853,243

(22) Filed: May 26, 2004

(65) Prior Publication Data

US 2005/0152801 A1 Jul. 14, 2005

Related U.S. Application Data

(63) Continuation-in-part of application No. 10/758,259, filed on Jan. 16, 2004, now abandoned, and a continuation-in-part of application No. 10/756,262, filed on Jan. 14, 2004, now abandoned.

(51) Int. Cl.
*B65D 6/08* (2006.01)
*B65D 1/32* (2006.01)
*B65D 33/28* (2006.01)

(52) U.S. Cl. ..... 220/495; 220/723; 383/72

(58) Field of Classification Search ..... 220/723, 220/FOR. 116; 383/72, 119, 121; 206/524.8
See application file for complete search history.

(56) References Cited

U.S. PATENT DOCUMENTS

| | | | | |
|---|---|---|---|---|
| 3,061,165 | A | 10/1962 | Rench et al. | |
| 4,786,192 | A * | 11/1988 | Graves et al. | 383/119 |
| 5,080,155 | A * | 1/1992 | Crozier | 150/154 |
| 5,746,317 | A * | 5/1998 | Turner et al. | 206/423 |
| 6,135,253 | A | 10/2000 | Weissman et al. | |
| 6,202,849 | B1 * | 3/2001 | Graham | 206/524.8 |
| 6,499,574 | B1 * | 12/2002 | Anthony | 190/36 |
| 6,874,879 | B2 * | 4/2005 | Haan et al. | 347/86 |
| 2002/0162767 | A1 * | 11/2002 | Ohtsubo | 206/524.8 |

FOREIGN PATENT DOCUMENTS

| | | |
|---|---|---|
| CN | 2186723 | 1/1995 |
| CN | 1384030 | 12/2002 |
| CN | 200420102078 | 1/2006 |
| CN | 200420102082 | 1/2006 |
| CN | 200420102469 | 1/2006 |
| CN | 200420102080 | 2/2006 |
| CN | 200520053725 | 3/2006 |

(Continued)

OTHER PUBLICATIONS

Chinese Search Report for ZL2004008963.0 dated Oct. 22, 2008.

*Primary Examiner*—Anthony D Stashick
*Assistant Examiner*—Shawn M Braden
(74) *Attorney, Agent, or Firm*—Lowe Hauptman Ham & Berner, LLP

(57) ABSTRACT

A combined storage apparatus comprises a storage bag and a storage box. The bottom of the storage bag forms an extended flat surface and is attached with a stiff board. Two sides of the stiff board are provided with locking members. Thereby, after the storage bag contains an article and is vacumed, two lateral sections of the stiff board are folded upward to form two sidewalls. The storage bag is then placed into the storage box. Since the combined storage apparatus is boxy and of tough structure, a plurality of them can be stacked up so as to save storage space.

1 Claim, 5 Drawing Sheets

FOREIGN PATENT DOCUMENTS

| | | | |
|---|---|---|---|
| CN | 200410052555 | | 6/2006 |
| CN | 200410052556 | | 6/2006 |
| CN | 200410077349 | | 6/2006 |
| CN | 200520060109 | | 8/2006 |
| CN | 200520062135 | | 8/2006 |
| CN | 200520060108 | | 11/2006 |
| CN | 200520056506 | | 12/2006 |
| CN | 20062001700.3 | | 3/2007 |
| CN | 200620057800 | | 5/2007 |
| CN | 200520060143 | | 6/2007 |
| CN | 200620059067 | | 7/2007 |
| CN | 200620059992 | | 7/2007 |
| CN | 200620056796 | | 9/2007 |
| CN | 20050059378 | | 10/2007 |
| CN | 200620059068 | | 11/2007 |
| CN | 200610035819 | | 12/2007 |
| CN | 200720047526 | | 12/2007 |
| CN | 200720047450 | | 1/2008 |
| CN | 200720047559 | | 1/2008 |
| CN | 200720050030 | | 3/2008 |
| CN | 200720050031 | | 3/2008 |
| CN | 200720053099 | | 6/2008 |
| CN | 200720055586 | | 7/2008 |
| CN | 200720055587 | | 7/2008 |
| CN | 200720055759 | | 8/2008 |
| CN | 200720059333 | | 9/2008 |
| DE | 4430211 | A1 | 3/1996 |
| JP | 3031397 | U | 3/1991 |
| JP | 3081548 | U | 4/1991 |
| JP | 3091389 | U | 4/1991 |
| JP | 4062486 | U | 5/1992 |
| JP | 05-019135 | U | 1/1993 |
| JP | 6199354 | | 7/1994 |
| JP | 2004042972 | A | 2/2004 |
| JP | 06008281 | U | 1/2009 |

* cited by examiner

COMBINED STORAGE APPARATUS

The invention is a continuation in part of U.S. patent Ser. No. 10/756,262 filed Jan. 14, 2004 now abandoned & Ser. No. 10/758,259 filed Jan. 16, 2004 now abandoned which are assigned to the invention of the present invention, and thus the contents of the U.S. Patent with Ser. Nos. 10/756,262 & 10/758,259 are incorporated into the application as a part of the specification.

BACKGROUND OF THE INVENTION (a) Field of the Invention

Being a continuous improvement from two U.S. patent applications filed on Jan. 16, 2004 by the same applicant, the present invention relates to combined storage apparatuses, more particularly to a combined storage apparatus wherein a storage bag is provided with an extended flat bottom surface attached with a stiff board. An article is stored in the storage bag, and the storage bag is vacuum and then placed in a storage box.

(b) Description of the Prior Art

The storage bags for storing blankets or clothes of the prior art comprise a bag body that can be sealed and vacuumed, so that its volume can be significantly reduced for saving space. However, since the storage bags of the prior art are in irregular shapes and it is difficult to stack up many storage bags. It is further disadvantageous that the expansions of the bags, due to infiltration of air, will eventually collapses the stacked bags.

SUMMARY OF THE INVENTION

The primary objective of the present invention is to provide a combined storage apparatus comprising a storage bag and a storage box. The bottom of the storage bag forms an extended flat surface and is attached with a stiff board. Two sides of the stiff board are provided with locking members. Thereby, after the storage bag contains an article and is vacuumed, two lateral sections of the stiff board are folded upward to form two sidewalls. The storage bag is then placed into the storage box. Since the combined storage apparatus is boxy and of tough structure, a plurality of them can be stacked up so as to save storage or placement space.

The secondary objective of the present invention is to provide a combined storage apparatus wherein the flat bottom of the storage bag is attached with a stiff board. The stiff board is provided with at least one set of locking members, such as binding ribbons and buckle belts. After the storage bag is vacuumed and shrunk, the locking members are engaged to bind the storage bag, which bag is then stored within the storage box. The locking members prevent the storage bag from expansion due to air infiltration, sustaining compact storage space and shape.

The various objects and advantages of the present invention will be more readily understood from the following detailed description when read in conjunction with the appended drawings.

DETAILED DESCRIPTION OF THE PREFERRED EMBODIMENTS

Figure 1:
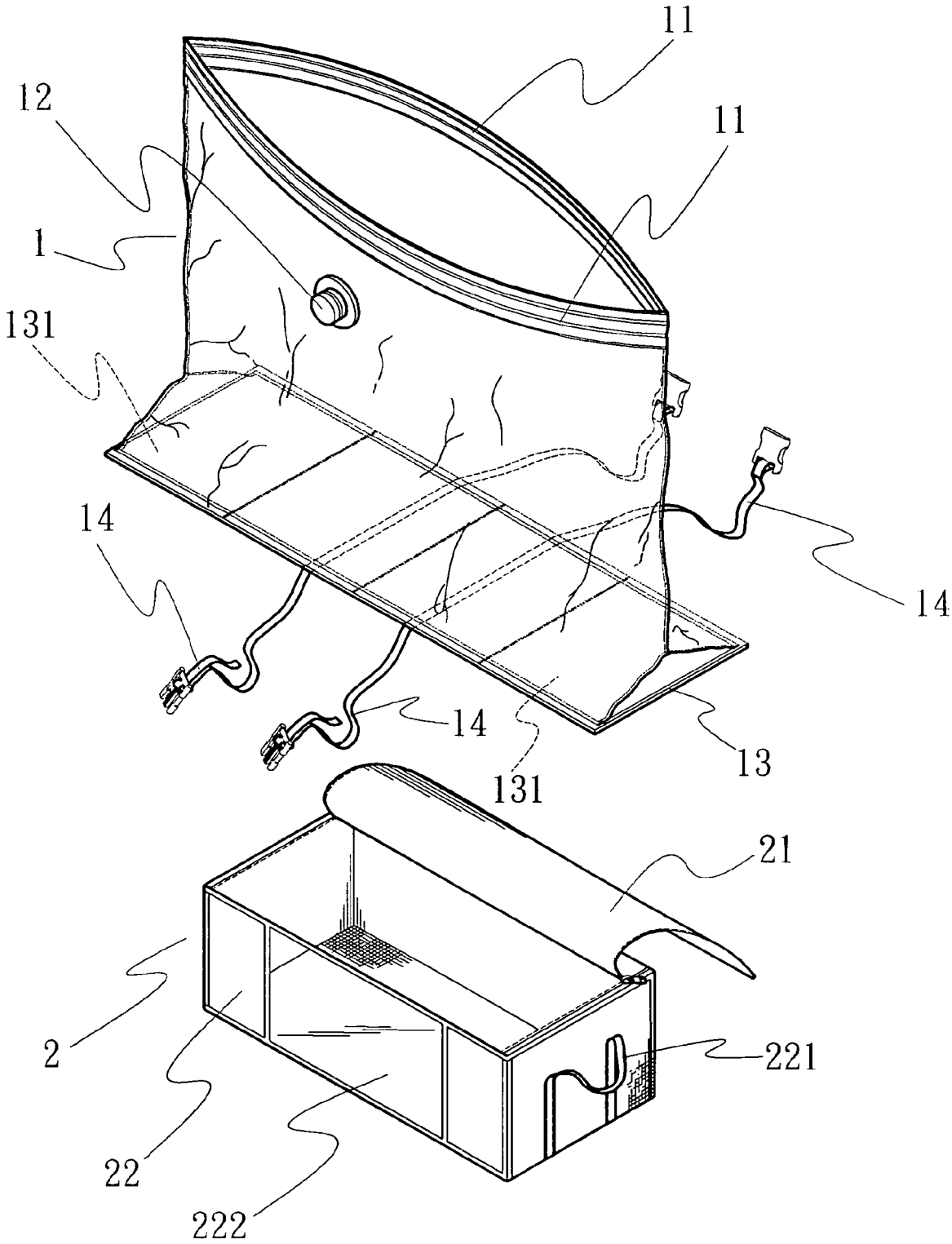
FIG. 1 is a perspective view of a combined storage apparatus according to the present invention wherein the storage bag and the storage box are separated.
Figure 2:
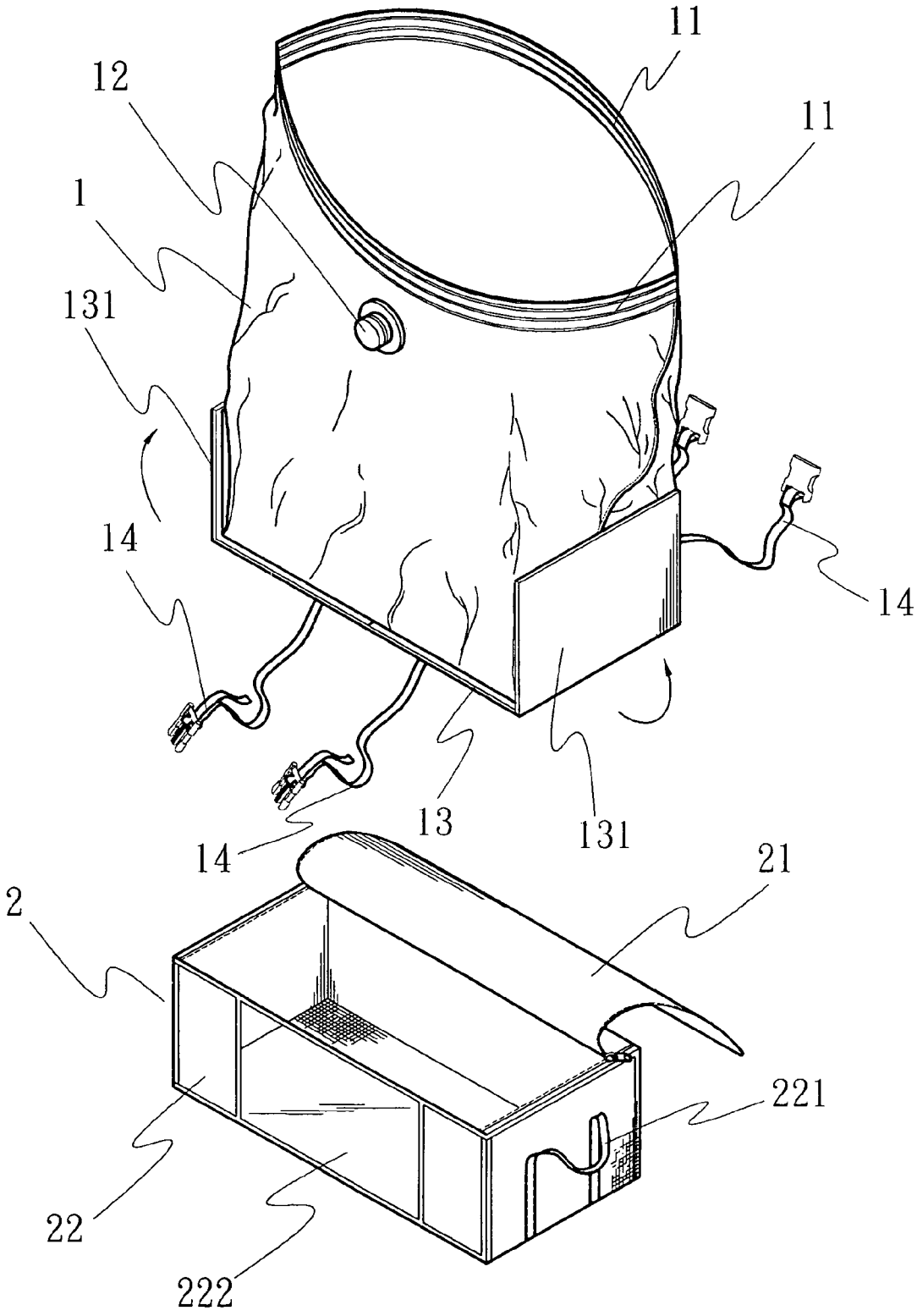
FIG. 2 is a perspective view of a combined storage apparatus according to the present invention wherein the bottom board of the storage bag is folded to form two sidewalls.
Figure 3:
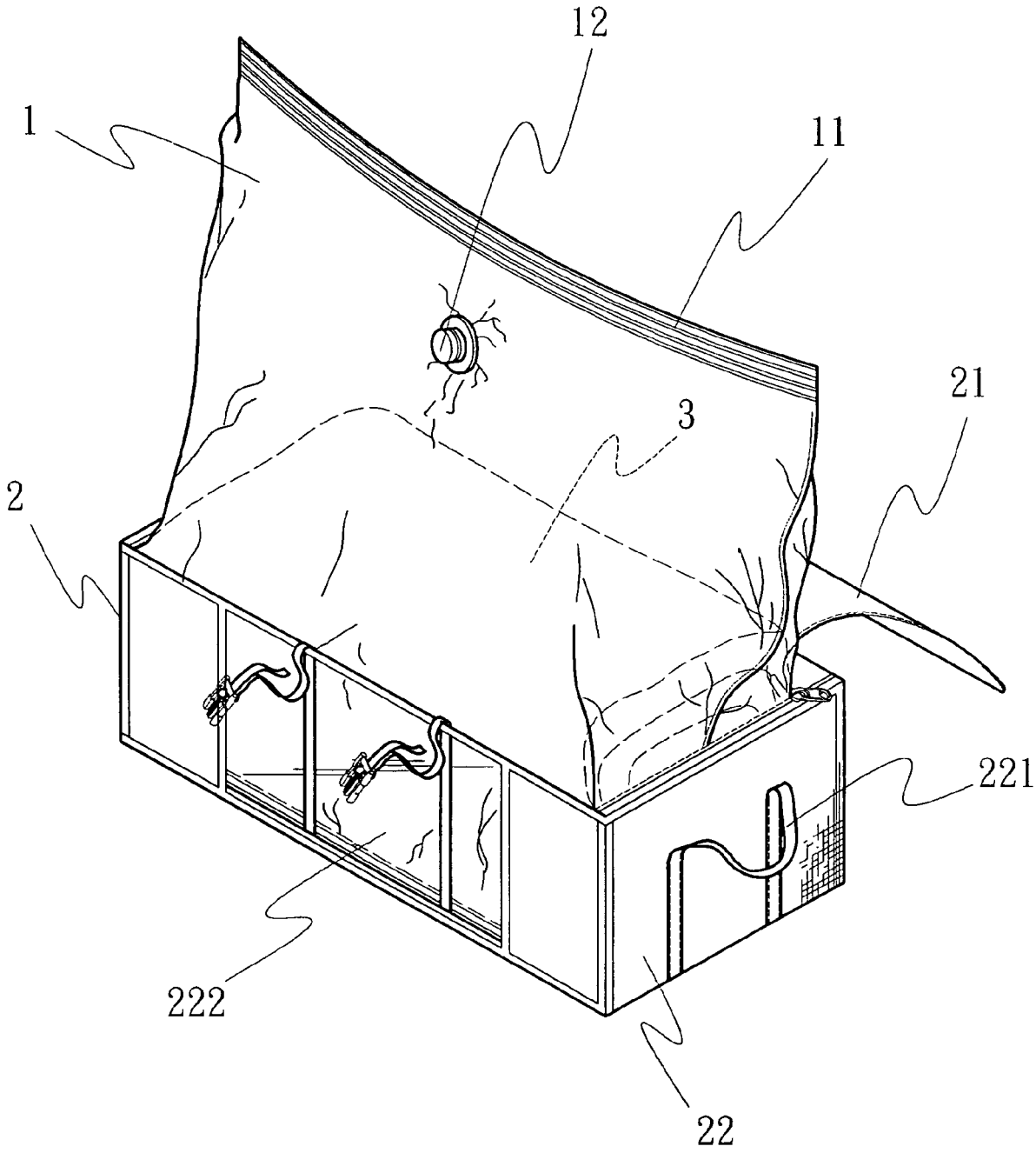
FIG. 3 is a perspective view of a combined storage apparatus according to the present invention wherein the storage bag is housed in the storage box.
Figure 4:
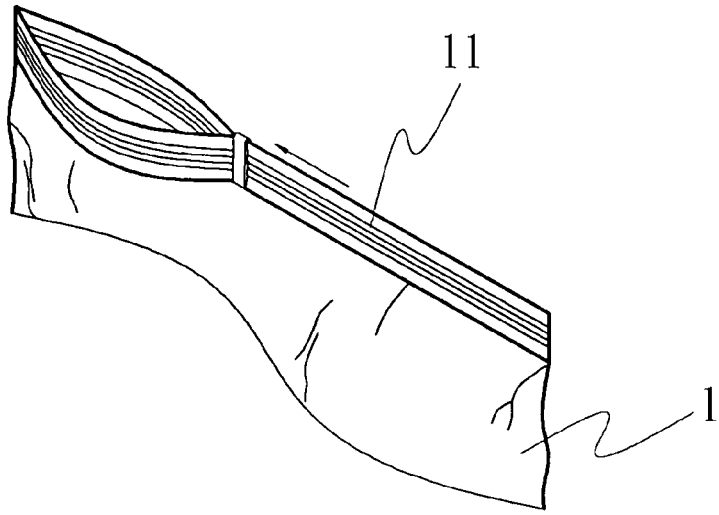
FIG. 4 illustrates the sealing of the opening of the storage bag by pulling a zipper thereof.
Figure 5:
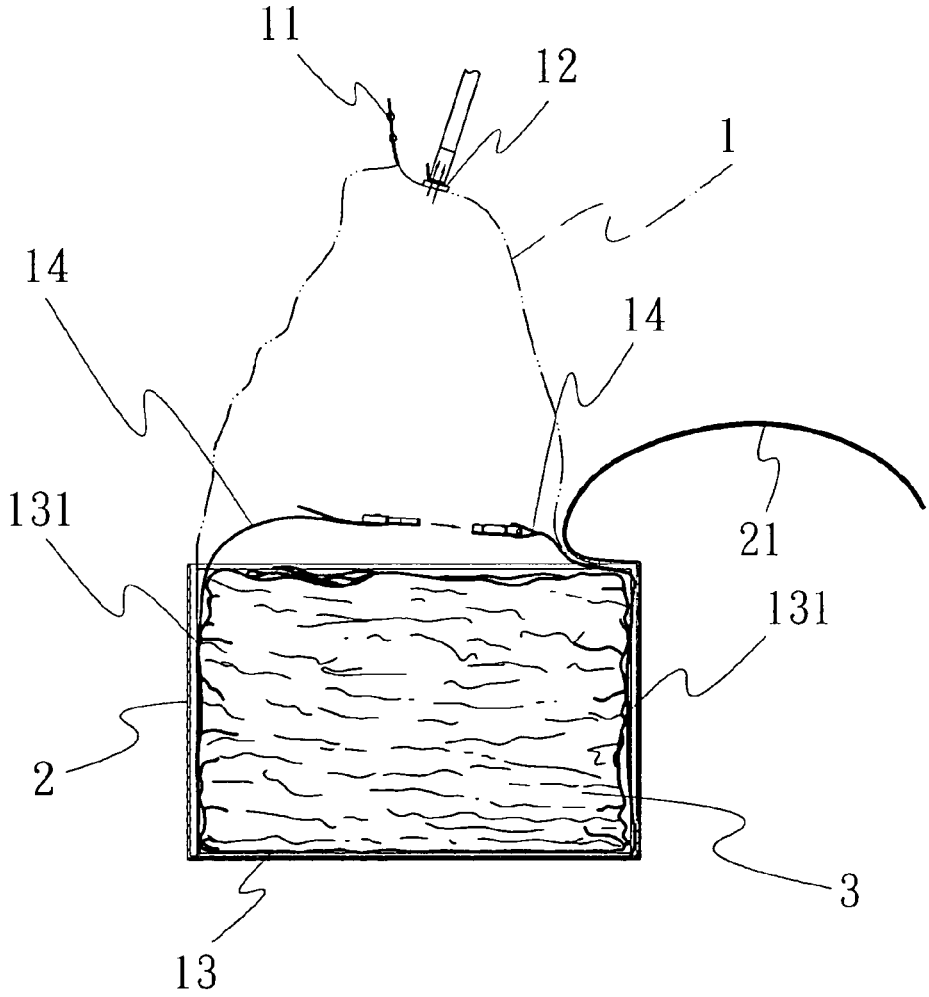
FIG. 5 is a lateral cross-sectional view of the present invention illustrating the air in the storage bag being extracted.
Figure 6:
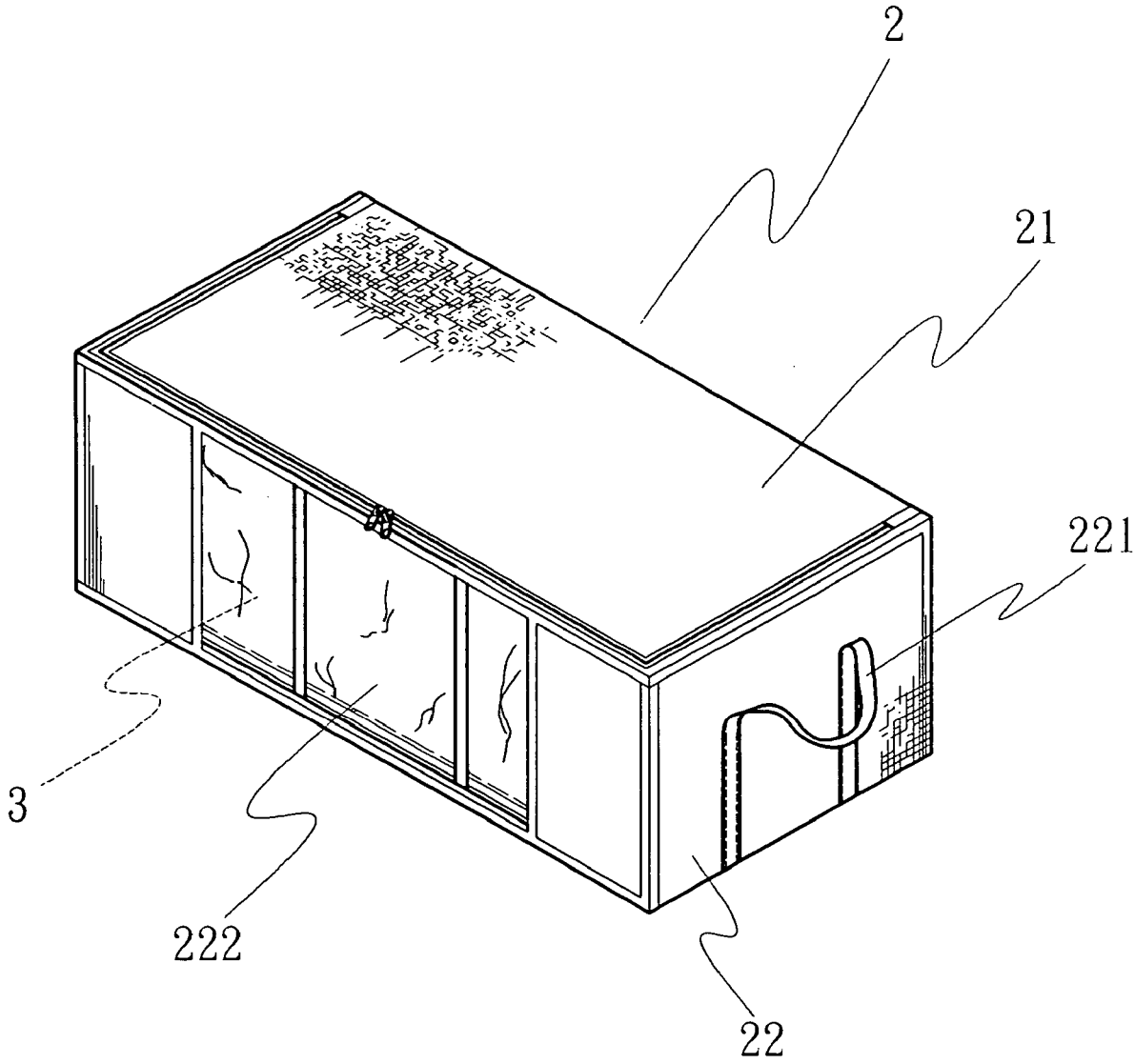
FIG. 6 is a perspective view of the present invention wherein the storage bag is enclosed in the storage box.

Referring to FIG. 1 and 2, a combined storage apparatus according to the present invention comprises a storage bag 1 and a storage box 2. The opening of the storage bag 1 is provided with two parallel snap strips 11 extending along two sides of the opening. Combining two snap strips 11 together can seal the storage bag 1. The storage bag 1 is further provided with a one-way air valve 12 at a selected location thereof. The bottom of the storage bag 1 is provided with a horizontal flat surface that includes a stiff board 13. A plurality of parallel locking members 14, such as binding ribbons and buckling belts, are attached on the bottom face of the stiff board 13, running across the stiff board 13 and be capable of enclosing the storage bag 1 above. Two sections on opposite sides of the stiff board 13 can be folded upward to form two sidewalls 131.

The storage box 2 further includes a box body 22 and an upper flap 21 for closing the box body 22. The box body 22 can house the storage bag 1 after the storage bag 1 is folded. The box body 22 is further provided with two handles 221 on two short sides thereof and a window 222 made of transparent material on one long side thereof.

Thereby, an article, such as bedding or clothing, can be stored in the storage bag 1. The storage bag 1 is then sealed after combining the snap strips 11 and vacuumed. Two sidewalls 131 of the stiff board 13 are folded upward to erect the storage bag 1. Finally, the storage bag 1 is bound by connecting the locking members 14 and placed into the storage box 2. Since the combined storage apparatus is boxy, it is easy to stack up multiple units, therefore saving storage space.

Further, the sidewalls 131 extended from the stiff board 13 of the storage bag 1 reinforce the toughness of the storage box 2 after the storage bag 1 is placed into the storage box 2. Therefore, the storage box 2 can sustain stress due to stacking up for an extended time without deformation.

The aforesaid locking members 14 of the stiff board 13 can be binding ribbons or buckle belt as shown in the figures, for preventing expansion of stored articles due to air leakage into the storage bag 1. It provides an equivalent effect that the locking members 14 are disposed on two long sides instead.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A combined storage apparatus, comprising:

a storage bag having two opposite sides, an opening between said two opposite sides and two snap strips respectively along said two opposite sides of said opening said snap strips sealing said storage bag, said storage bag further including a one-way air valve for extracting air therein, said storage bag further including a stiff board having two foldable lateral sections on opposite sides thereof foldable upwardly to form two side walls and extending over a bottom side thereof, whereby said storage bag is expandable; and a storage box having a box shaped body, an upper flap for closing the body, an inner space or housing said storage bag; two long sides and two short sides with a handle on each short side, and a transparent window on one long side and wherein said stiff board further includes a plurality of binding ribbons or buckle belts running across said stiff board with said binding ribbons attached on the bottom face of said stiff board and whereby said storage bag is adapted to contain an article extracted of air housed in said storage box and wherein said lateral sections are on opposite sides of said stiff board reinforce the toughness of said storage box after said storage bag is placed in said storage box.

* * * * *